United States Patent [19]

Kawashima et al.

[11] 4,443,317

[45] Apr. 17, 1984

[54] ELECTRODE FOR ELECTROLYSIS AND PROCESS FOR ITS PRODUCTION

[75] Inventors: Yukio Kawashima; Makoto Kobayashi; Mayu Murakami, all of Tokyo, Japan

[73] Assignee: TDK Electronics Co., Ltd., Tokyo, Japan

[21] Appl. No.: 433,390

[22] Filed: Oct. 8, 1982

[30] Foreign Application Priority Data

Oct. 8, 1981 [JP] Japan ..... 56-160453

[51] Int. Cl.[3] ..... C25B 11/00; C25C 7/02

[52] U.S. Cl. ..... 204/290 F; 427/125; 427/126.5

[58] Field of Search ..... 204/290 F; 252/423.5; 427/125, 126.5

[56] References Cited

U.S. PATENT DOCUMENTS

| | | | |
|---|---|---|---|
| 3,663,280 | 5/1972 | Lee | 427/126.5 |
| 3,751,296 | 8/1973 | Beer | 204/290 F |
| 3,846,273 | 11/1974 | Bianchi | 204/290 F |
| 4,214,971 | 7/1980 | Heikel | 204/290 F |
| 4,248,906 | 2/1981 | Saito | 204/290 F |
| 4,252,628 | 2/1981 | Boulton | 204/290 F |
| 4,285,798 | 8/1981 | Yoshida | 204/290 F |
| 4,313,814 | 2/1982 | Saito | 204/290 F |

*Primary Examiner*—John F. Niebling

*Attorney, Agent, or Firm*—Oblon, Fisher, Spivak, McClelland & Maier

[57] ABSTRACT

An electrode for electrolysis having a coating which consists esentially of 40 to 90 mole % of palladium oxide, 0.1 to 20 mole % of platinum, and 5 to 50 mole % of $(Ru_xTi_{1-x})O_2$ wherein x ranges from 0.05 to 0.5, based on the total molar composition.

The electrode of the present invention has excellent corrosion resistance and mechanical resistance against foams generated during electrocatalysis.

12 Claims, No Drawings

ELECTRODE FOR ELECTROLYSIS AND PROCESS FOR ITS PRODUCTION

DETAILED DESCRIPTION OF THE INVENTION

BACKGROUND OF THE INVENTION

1. Technical Field

This invention relates to an improved electrode for electrolysis and a process for its production.

2. Description of the Prior Art

Heretofore, most of the alkali metal salt electrolysis represented by the electrolysis of saline water has been done by the so-called "mercury process". In recent years, however, the environmental pollution caused by mercury contained in the waste matter from the process has become a serious social problem, and a turnabout from the "mercury process" to the so-called "diaphragm process" and "ion-exchange membrane process" has been required.

Usually, in the diaphragm process and the ion-exchange membrane process, a higher pH value than in the mercury process is used at the time of the electrolysis, and the electrodes which are known are generally low in their oxygen overpotential. On account of this, the asbestos diaphragm process and the ion-exchange membrane process necessarily mixes 1 to 3% or so of oxygen into chlorine gas to be generated. As the consequence of this, the chlorine obtained from these processes cannot be supplied directly to petro-chemical plants, rather the oxygen must be removed prior to its use. On account of this, special apparatus and complicated operations are necessary, which constitutes one of the causes for increased cost of production.

In solving such a problem an electrode which generates as low an amount of oxygen as possible may be used. However, the equilibrium potential $EO_2$ of oxygen is lower than the equilibrium potential $ECl_2$ of chlorine, owing to which an electrode having no selectivity at all with respect to the electrode reaction with oxygen and chlorine should always accompany generation of a large amount of oxygen at a potential for the chlorine generation.

In order therefore to suppress generation of oxygen as far as possible, it is necessary that the shielding material for the electrode be imparted with a characteristic which tends to make it difficult for the oxygen electrode reaction proceed from the standpoint of the theory of rate process.

Usually, the selectivity of the electrode to such reaction is termed "electrocatalysis", wherein the exchange current density of each shielding material for the electrode is used as the yardstick. Various platinum group elements such as ruthenium, palladium, rhodium, platinum, and iridium are examples of elements which exhibit electrocatalysis.

When these elements are arranged in the order of magnitude of their exchange current density, they are Ru>Ir>Rh>Pd>Pt in respect of the oxygen electrode reaction, while they are Pd>Ru>Ir>Rh>Pt in respect of the chlorine electrode reaction.

From the above, it is seen that palladium best serves the purpose in the point that it produces less oxygen and is excellent in its electrocatalysis for the chlorine electrode reaction.

In practical use, however, when the electrode is coated with palladium in metal form, its corrosion-resistant property is inferior and the coating becomes dissolved at the time of the electrolysis with the consequent problem of its inability of being put to practical use.

With a view to solving this problem, there have been proposed various corrosion-resistant electrodes such as that made of a platinum/palladium alloy, or that made by coating a substrate (base plate) with this alloy, or that obtained by oxidizing the surface of this alloy (vide: Japanese patent publication No. 11014/1970, Japanese patent publication No. 11015/1970). These electrodes, however, do not exhibit the excellent electrocatalysis of palladium per se, as the palladium has been changed to an alloy, and, moreover, are not durable with respect to their corrosion-resistant property over a long period of time.

There has also been proposed an electrode made of an oxide of platinum/palladium alloy (vide: Japanese patent publication No. 3954/1973). In practice, however, the alloy oxide must be treated in an oxygen atmosphere at a high temperature and under a high pressure for the alloy oxide to be formed on a titanium base plate. In so doing, the titanium base plate undergoes considerable oxidation and is incapable of being used as the electrode. On account of this, the abovedescribed method coats the platinum/palladium alloy on the titanium base plate to form the alloy oxide by anodic oxidation, although it is similar to as the above mentioned electrode of the alloy, the surface of which has been oxidized.

On the other hand, an attempt has also been made to coat palladium in its oxide form on a base plate of a valve metal such as titanium, by first applying a compound which turns into palladium oxide through pyrolysis on the base plate, and then thermally decomposing the same. However, no success could be attained because of low adhesion between the titanium base plate and palladium oxide.

After much investigation, it was found that improved adhesive property is obtained when a small quantity of other metal oxide is included in a large quantity of palladium oxide for the coating at the time of effecting the pyrolytic process. However, when the palladium oxide coating is to be applied on the titanium base plate by the pyrolytic process, if titanium is in direct contact with palladium oxide or unreacted palladium compound as the raw material, the palladium compounds are reduced by titanium to deposit metallic palladium, which then enters the palladium oxide as a mixture component. Due to this, even when the adhesive property becomes improved to a certain degree, the electrode so formed is of no practical use, since the metallic palladium which has been deposited as mentioned above dissolves at the time of the electrolysis to render the coating to be porous, which tends to cause the coating to be separated from the base plate with generation of gas from the electrode surface, changing its corrosion-resistant property with lapse of time.

In view of these facts, the present inventors have previously proposed a process for producing an electrode, wherein a coating consisting of palladium oxide as a perfect oxide and a platinum metal is applied on the valve metal base plate made of titanium, tantalum, zirconium, and so forth (vide: Japanese patent publication No. 8595/1980, and others).

The feature of this process for producing the electrode is not to apply directly the palladium compound capable of being pyrolyzed on the base material, followed by the thermal decomposition, but is to pyrolyze, beforehand, palladium chloride, for example, in the oxygen atmosphere, or to oxidize, in advance, palladium black in the oxygen atmosphere to thereby prepare perfect palladium oxide.

The thus prepared palladium oxide is dispersed in a butanol solution of a platinum compound which turns into the platinum metal by pyrolysis such as, for example, chloroplatinic acid, with addition of a dispersing agent, to thereby prepare a coating liquid. This coating liquid is applied onto the base plate which has been subjected to mechanical and chemical etching, followed by baking. According to this method, production of the metallic palladium cannot be recognized at all, and, moreover, a film thickness several times as thick as that obtained by the conventional thermal decomposition process can be obtained by one coating operation, due to which the corrosion-resistant property of the electrode improves. It is noted that, platinum to be contained simultaneously with palladium, in this case, is required to be platinum metal in its coated condition.

This improves the adhesive property between palladium oxide and the base plate, on which palladium oxide is to be coated, and improves the electrical contact among particles of palladium oxide so as to cause them to decrease the electrical resistance of palladium oxide which facilitates the electro-chemical catalysis.

While the above mentioned electrode is satisfactory as to its use in electrocatalysis and corrosion-resistant property, it has serious the defect that the electrode coating tends to bring about mechanical separation with generation of foams at the time of the electrolysis.

In order to solve this shortcoming, methods have already been proposed wherein, after the above mentioned electrode coating has been formed, a platinum metal coating is further applied thereon at a later stage from a compound which turns into the platinum metal by this pyrolysis, and a method, in which the electrode coating and the platinum metal coating to be formed by the above mentioned method are applied in multi-layered structure in an arbitrary sequence (vide: Japanese unexamined patent publication No. 43879/1979 and Japanese patent publication No. 36713/1980). According to these methods, the electrocatalysis and the corrosion-resistant property of the resulting electrode are high, and moreover, the mechanical separation of the coating with generation of foams at the time of the electrolysis is remarkably reduced.

Nevertheless, such multi-layered coating with two liquid type coating liquid has such disadvantages that the number of its coating steps increases, its manufacturing becomes complicated and troublesome, and the film thickness or the coating as well as the quantitative ratio of the coating components are difficult to be controlled.

Further, the electrode for electrolysis is often subject to friction and/or scratching from various objects such as supporting mechanisms for tools, packing materials, human hands, diaphragms, and others during the working processes after formation of the coating film, during transportation of the electrode after the working, or during its installation into the electrolytic vessel, or further during the electrolytic operation. In such circumstances, the electrode as mentioned above is insufficient in its mechanical strength against such friction, etc., even if the mechanical separation of the coating due to generation of foams is reduced.

In addition, a fairly large amount of platinum which is not abundant in the natural resources is used.

In the proposed method of multi-layered coating as mentioned in the foregoing, it is also noted that, when cerium, zirconium, titanium, tantalum, tungsten, or other metals are simultaneously added to the coating liquid in the form of halides, organic salts, and so on, and are turned into oxides by heating, and included in the coating, the mechanical strength of the coating is improved. It is certain that, when these oxides are included, the mechanical strength of the coating is improved even against the above mentioned friction, but the improvement is still not necessarily satisfactory, and various inconveniences have been recognized. For example, even when the mechanical strength to friction is satisfactory, the film resistance increases in that case to bring about a increase in the vessel voltage due to the increased chlorine overpotential, and the service life of the electrode becomes short.

SUMMARY OF THE INVENTION

It is an object of the present invention to provide an electrode for electrolysis having a coating containing therein palladium oxide, the electrode coating being fully satisfactory with respect to its electrocatalysis, corrosion-resistant property, and magnitude of mechanical strength against generation of foams at the time of the electrolysis; having sufficiently large mechanical strength against friction, scratch, etc. which are often applied to the electrode surface during transportation, and installation of the electrode; being low in its vessel voltage; and being remarkably long in its service life. It is also an object of this invention to provide a preferred process for production of such electrode for electrolysis.

It is also an object of the present invention to provide an electrode for electrolysis and a process for its production, which can be produced with a single liquid type coating liquid without use of various kinds of coating liquid.

Moreover, it is also an object of the present invention to provide an electrode and a process for its production, which is capable of reducing a quantity of platinum for use in realizing the objects already described above.

DETAILED DESCRIPTION OF THE PREFERRED EMBODIMENTS

The other objects and attendant features of the present invention will become more apparent from the following description thereof.

It has been discovered that such objects could be effectively attained when a predetermined ratio of $(RuTi)O_2$ is included in the coating liquid together with palladium oxide, and this discovery is the basis for the present invention.

In more detail, the present invention provides an electrode for electrolysis having a coating which is composed of 40 to 90 mol % of palladium oxide, 0.1 to 20 mol % of platinum, and 5 to 50 mol % of $(Ru_xTi_{1-x})O_2$ (where x ranges from 0.05 to 0.5); and a process for producing an electrode for electrolysis wherein a coating liquid containing palladium oxide, a salt which turns into platinum metal by pyrolysis, a salt which turns into ruthenium oxide by pyrolysis, and a salt which turns into titanium oxide by pyrolysis is coated on an electrically conductive base material, followed by heating, to thereby form a coating of a composition consisting of 40 to 90 mol % of palladium oxide, 0.1 to 20 mol % of platinum, and 5 to 50 mol % of $(Ru_xTi_{1-x})O_2$ (where x ranges from 0.05 to 0.5).

It is noted that, in the coating according to the present invention, it is palladium oxide alone that functions as the electrocatalytic active substance for the electrode, while platinum and $(RuTi)O_2$ do not exhibit the electrocatalytic activity for the electrode, but merely function as the electrically conductive material or a combining material, as will become apparent from the examples to be described. In view of this, the present invention is entirely different from those inventions as disclosed in Japanese patent publication No. 3954/1973 and Japanese patent publication No. 31102/1978, etc. which utilize alloys of the platinum group and solid-solution of metal oxides belonging to the platinum group, as the electrocatalytic active substances.

Further, Japanese patent publication No. 35473/1980 discloses an electrode having a coating consisting, for example, of 17.3 wt.% (12 mol %) of palladium oxide, 13.6 wt.% (6 mol %) of platinum, 69.1 wt.% (44 mol %) of $RuO_2$, and 35.2 wt.% (38 mol %) of $TiO_2$. However, the electrode as described in this publication is entirely different in its compositional ratio from that of the present invention, wherein $RuO_2$ exhibits the electrocatalytic activity for the electrode. Furthermore, the electrode coating is produced by the aforementioned thermal decomposition process, which does not at all realize various predetermined effects according to the present invention.

Moreover, the predetermined effects of the present invention cannot be realized, even when $(RuTi)O_2$ in the present invention is replaced by other oxides or compound oxides.

For the electrically conductive base material for the electrode for electrolysis, it is preferable to use valve metals such as titanium, for example tantalum, zirconium, niobium, etc., in particular, titanium. The shape, of the base material may be arbitrarily changed depending on its use.

The coating to be provided on the electrically conductive base material contains the afore mentioned particular components and composition, outside of which the predetermined effects of the present invention cannot be realized.

In this case, the amount of palladium oxide ranges from 40 to 90 mol %. When the amount does not reach 40 mol %, the electrocatalytic activity thereof lowers, Ru also exhibits electrocatalysis, and the quantity of the oxygen generation increases with a consequent decrease in the chlorine generating efficiency. On the contrary, when the amount exceeds 90 mol %, the adhesive strength between the coating and the base material is reduced.

However, a much more favorable result can be obtained when the quantity of palladium oxide is in a range of from 50 to 90 mol %.

Both $(Ru_xTi_{1-x})O_2$ and platinum in their predetermined quantitative ratio intrude into palladium oxide, and these substances fasten palladium oxide particles as the combining material with extremely high efficiency and with tight connection.

$(Ru_xTi_{1-x})O_2$ (where x is the same as mentioned in the foregoing) may be deviated somewhat from its regular composition, if it has a substantially stoichiometrical composition, and is present in the coating with a grain boundary from other substances. Usually, it exists as rutile-type solid-solution particles. The content of $(Ru_xTi_{1-x})O_2$ ranges from 5 to 50 mol %. In this instance, when the content does not reach 5 mol %, the mechanical strength of the coating is reduced, and the application of the single liquid coating material becomes difficult. On the contrary, when the content exceeds 50 mol %, the rate of coating of $(Ru_xTi_{1-x})O_2$ with respect to palladium oxide increases, and the characteristic property of $(Ru_xTi_{1-x})O_2$ becomes predominant to result in decreased chlorine generating efficiency.

On the other hand, the quantitative ratio x between Ru and Ti ranges from 0.05 to 0.5. When the ratio x is below 0.05, the electrical conductivity of $(Ru_xTi_{1-x})O_2$ is reduced, and the electric contact or conductivity between the base material and palladium oxide on the surface of the electrode coating is hindered, although the mechanical strength of the coating is satisfactory. On the contrary, when the ratio exceeds 0.5, the chlorine generating efficiency is lowered, and the oxygen generating quantity increases, and further the mechanical strength of the coating lowers.

The content of the platinum metal contained in the coating having a substantial grain boundary from each of palladium oxide and $(Ru_xTi_{1-x})O_2$ can be decreased to 20 mol % or below. In this instance, a single liquid type coating liquid can be used with good efficiency, and, moreover, the application of the coating can be done without irregularity, and yet the mechanical strength of the coating is high and its electrode characteristic is also favorable. In this case, when platinum of a quantity exceeding 20 mol % is used daringly, sufficient mechanical strength can no longer be obtained by application of single liquid type coating liquid.

On the other hand, when the content of the platinum is below 0.1 mol %, the life of the electrode becomes curtailed.

The coating having the above mentioned components and quantitative ratio should preferably be such that palladium possesses a loading of from 0.5 to 10 mg/cm$^2$ or so in terms of metal thereof. Further, thickness of the coating may generally range from 0.5 to 10 microns or so.

Also, while there is no particular necessity for inclusion of other components in the coating, various oxides such as cerium, zirconium, titanium, tantalum, tungsten, silicon, lead, tin, and antimony may be contained in a range of 10 mol % or so and below, depending on the intended use, without decreasing the predetermined effect of the present invention.

An electrode for electrolysis according to the present invention is manufactured in accordance with the following method of its production.

In the process for producing the electrode according to the present invention, various kinds of coating liquids are prepared, from which the coating having sufficiently high mechanical strength can be obtained without applying the coating liquid in two divided stages, or in a multi-layered structure. As a result of being able to apply the coating with the single liquid type coating liquid, the production becomes facilitated. Further, the coating thickness and the compositional ratio thereof can be readily controlled, with the least irregularity therein.

The application of the coating by use of the single liquid type coating liquid may be done in the following manner.

First of all, the coating liquid is prepared. The coating liquid is prepared by dissolving, or dispersing with use of various kinds of surfactants, depending on necessity, palladium oxide powder, halogenized platinic acid, a salt which turns into platinum metal by pyrolysis of, for example, chloroplatinic acid, a salt which turns into ruthenium oxide by pyrolysis of ruthenium chloride, and a salt which turns into titanium oxide by pyrolysis of titanium chloride or tetrabutoxy titanium, all being obtained in the advance by various processes or available in general market, into an appropriate solvent such as, for example, water, ethanol, propanol, butanol, or a mixture thereof.

The concentration of the coating liquid should preferably be from 0.01 to 10 g/ml in total, particularly, from 0.1 to 1 g/ml in terms of the metal quantity thereof from the point of its viscosity and ease of application. The compositional ratio in the coating is determined in accordance with the composition in the coating liquid.

The coating is formed by applying and heating such coating liquid.

The coating is done by any ordinary method such as the brush application or spray application. The quantity of application is so determined that the coating thickness and the loading may be in a predetermined value. When the required quantity cannot be obtained in a single coating operation, the application is repeated a number of times. In this case, heat-treatment is effected at every coating operation to bake the coated liquid. The baking conditions are such that the divided pressure for oxygen is controlled within a range of from 0.002 to 0.5 atmosphere, the coating is heated at every coating operation for 5 to 10 minutes at the optimum temperature of from 400° to 800° C., this operation being repeated for several times depending on necessity. More preferably, the baking for the final application or the single application should optimally be done by heating for 10 minutes to 1 hour at 400° to 800° C.

An electrode for electrolysis according to the present invention is extremely useful when it is employed for electrolysis of alkali halide such as the electrolysis of saline water for the soda industry, and for electrolysis of sea water, or saline for sterilization.

The electrode according to the present invention facilitates a sufficiently large degree of electrocatalysis, and has corrosion-resistance, and mechanical strength against generation of foams at the time of electrolysis. Further, it exhibits extremely high mechanical strength against friction, and scratching during its transportation, and actual installation. Furthermore, it has a low chlorine overpotential, a low vessel voltage, and a very long service life.

Moreover, in realizing such effects, the quantity of platinum used can be made extremely small.

Moreover, since the single liquid coating can be effected, the production of the electrode becomes simple and easy with the least irregularity in the coating thickness.

Further, according to the process for production of the present invention, such electrode can be manufactured extremely easily and efficiently with the single liquid type coating, and yet free from irregularity in every product.

As already discussed, platinum and $(Ru_xTi_{1-x})O_2$ in the coating do not exhibit electrocatalytic activity, but function as the electrically conductive combining material. As the result of this, they exhibit a high chlorine generating efficiency peculiar to palladium, and the oxygen generation is extremely low. In this case, when the composition of the coating becomes outside the compositional range of the present invention, and, in particular, when $(Ru_xTi_{1-x})O_2$ increases and PdO decreases, Ru exhibits electrocatalytic activity and the chlorine efficiency deteriorates.

Further, when $(RuTi)O_2$ in the coating is replaced with $(RuSn)O_2$, $(IrTi)O_2$, $(IrSn)O_2$, i.e., a rutile type solid-solution, any of the above mentioned various effects can not be attained in the practical use of the electrode, and $(RuTi)O_2$ alone exhibits excellent characteristics.

In addition, when $(RuTi)O_2$ is also replaced with other oxides, the various effects of the present invention as mentioned above cannot be realized.

In the following, the present invention will be explained in further details with reference to embodimental examples and comparative examples.

EXAMPLE 1

A fine powder of palladium oxide, chloroplatinic acid, ruthenium chloride, and tetrabutoxy titanium were dissolved and dispersed in a solution consisting of 1 ml of hydrochloric acid and 19 ml of n-butanol, thereby preparing a coating liquid of a composition consisting of 50 mol % of Pd, 10 mol % of Pt, 8 mol % of Ru, and 32 mol % of Ti. The concentration of the coating liquid was 0.7 g/ml in total in terms of the metallic components.

Next, this coating liquid was uniformly coated with a brush onto a titanium base material (1 mm in thickness and 13 mm in diameter) which had been de-fatted in advance and had been surface-treated for two hours with 10% oxalic acid, followed by drying and subsequent baking.

The baking was done in air at 500° C. for five minutes at every coating, the final baking alone having been done for 30 minutes. The coating and baking were repeated for eight times in all.

The thus obtained electrode (No. 1) coating consisted of PdO, Pt, and $(Ru_xTi_{1-x})O_2$. This electrode No. 1 was analyzed by the fluorescent X-ray method, the results of which are shown in Table 1 below.

Subsequently, electrode No. 1 was subjected to measurement for its overpotential by the potential scanning method in 5 M saline water at a temperature of 30° C. The results of the measurement revealed that the current density was 20 $A/dm^2$ and the overpotential was 0.02 volt or below.

Further, the chlorine generating efficiency of the electrode No. 1 was measured by the following method.

150 ml of 0.25 M saline water as the electrolytic liquid was subjected to electrolysis in a tightly closed electrolytic vessel with an "SUS 304" disc (30 mm in diameter) as a cathode, and under the conditions of 30° C., a current density of 20 $A/cm^2$, and an electrical quantity of 100 C. Then, the electrolytic liquid was taken out into a conical flask with a cap, and concentration of hypochlorite contained therein was measured by the iodometry using sodium thiosulfate.

The result indicated a very high value, which was 91%.

Apart from this, with a view to examining the film strength of the coating on this electrode No. 1, there was carried out a peeling test using cellophane adhesive tape. Although this method usually lacks quantitativeness, because the test results fluctuate considerably due to a degree of pressure-adhesion of the cellophane tape, it is simple and easy in its handling, and, moreover, it is a much severer test than the vibration peeling test using ultrasonic waves which has already been disclosed in an earlier application. For this reason, therefore, the present invention has adopted the method for judgement of the mechanical strength of the coating against mechanical friction. While the judgement of the strength of the coating can be done clearly with naked eyes, this method was such that more than three samples for each composition were tested, wherein a quantity of Pd on the base plate before and after the test was measured and determined by the fluorescent X-ray analysis. In the Table 1, a symbol ⓞ indicates that the peeling quantity of Pd ranges from 0 to 2%, ○ indicates the quantity of from 2 to 10%, Δ the quantity of from 10 to 20%, and X the quantity of 20% and above. And, as shown in Table 1, the electrode No. 1 showed a very high film strength.

Further, the accelerated test for the corrosion-resistant property was carried out. The accelerated test for the corrosion-resistant property was based on the method of Vaaler [J. Electrochem. Soc., 117 219 (1970)], wherein a chlorine-saturated solution consisting of 0.5 M NaCl and 2 M $NaClO_4$ was electrolyzed with a current density of 100 A/dm$^2$ at 65° C. under mild agitation, while maintaining a pH value at 3. At an instant when the vessel voltage indicated 4 volts, the electrolysis was stopped, and a length of time which was required thus far for the electrolysis was regarded as the life of the electrode, the result being shown in Table 1. In the Table, a symbol ◎ indicates 2,500 hours and above, ○ indicates 1,500 to 2,500 hours, Δ500 to 1,500 hours, and X 500 hours or below. As the results of various studies made by the present inventors, this acceleration method is considered to be approximately 15 to 20 times of speed accelerated as that when the electrode is actually installed in the electrolytic vessel. And, the electrode No. 1 indicated a very long service life, as shown in Table 1.

COMPARATIVE EXAMPLE 1

For the sake of comparison, the following electrodes Nos. 5 to 12 were manufactured on the basis of Example 1.

No. 5: The composition of the coating liquid, was 50 mol % of Pd, 10 mol % of Pt, and the remainder portion of 40 mol % consisting of Ru:Ti=6:4 (x=0.6).

No. 6: The composition of the coating liquid was 50 mol % of Pd, 10 mol % of Pt and 40 mol % of Ru (x=1).

No. 7: The composition of the coating liquid was 50 mol % of Pd, 10 mol % of Pt, and 40 mol % of Ti (x=0).

No. 8: The composition of the coating liquid was 12 mol % of Pd, 6 mol % of Pt, 44 mol % of Ru, and 38 mol % of Ti, as disclosed in Japanese patent publication No. 3954/1973 (provided that, different from the above patent publication, the charged materials of the coating liquid used were palladium oxide, chloroplatinic acid, ruthenium chloride, and tetrabutoxy titanium, on the basis of Example 1 and in the same manner as the other electrodes No. 1 to No. 12).

No. 9: The composition of the coating liquid was made 50 mol % of Pd and 50 mol % of Pt.

No. 10: As the coating liquid, two types of liquid were used; the one contained palladium oxide and chloroplatinic acid, and the other contained chloroplatinic acid alone. These liquids were sequentially coated in a multi-layered structure, the coating composition of which was 50 mol % of Pd and 50 mol % of Pt.

No. 11: The composition of the coating liquid was 100% of Ru.

No. 12: The composition of the coating liquid was 30 mol % of Ru and 70 mol % of Ti.

TABLE 1

| Electrode No. | | Composition of the coating liquid (mol %) loading (mg/cm$^2$) Pd | Pt | Ru | Ti | Chlorine Over-potential (V) | Chlorine Generating Efficiency (%) | Peeling Test | Accelerated Test (Electrolytic Time) |
|---|---|---|---|---|---|---|---|---|---|
| 1 | | 50(0.988) | 10(0.367) | 8(0.152) | 32 | ≦0.02 | 91 | ◎ | ◎ |
| 2 | | 50(1.060) | 10(0.381) | 12(0.231) | 28 | ≦0.02 | 91 | ◎ | ◎ |
| 3 | | 50(1.015) | 10(0.371) | 16(0.310) | 24 | ≦0.02 | 91 | ◎ | ◎ |
| 4 | | 50(1.028) | 10(0.380) | 20(0.385) | 20 | ≦0.02 | 91 | ◎ | ◎ |
| 5 | | 50(1.065) | 10(0.385) | 24(0.462) | 16 | ≦0.03 | 88 | ◎ | ○ |
| 6 | Comparison | 50(0.985) | 10(0.365) | 40(0.760) | — | ≦0.03 | 82 | ○ | ◎ |
| 7 | Comparison | 50(1.033) | 10(0.380) | — | 40 | >0.1 | 77 | ◎ | X |
| 8 | Comparison | 12(0.291) | 6(0.278) | 44(1.110) | 38 | ≧0.12 | 84 | ◎ | Δ |
| 9 | Comparison | 50(0.981) | 50(1.770) | — | — | ≦0.02 | 91 | X | ○ |
| 10 | Comparison | 50(0.983) | 50(1.774) | — | — | ≦0.02 | 91 | Δ | ○ |
| 11 | Comparison | — | — | 100(1.130) | — | ≧0.10 | 76 | ◎ | ○ |
| 12 | Comparison | — | — | 30(1.071) | 70 | ≧0.15 | 86 | ◎ | ◎ |

EXAMPLE 2

In the same manner as in Example 1, electrodes Nos. 2 to 4 were produced on the basis of Example 1 with the composition of the coating liquid thereof being 50 mol % of Pd and 10 mol % of Pt, and with a ratio of Ru and Ti in the remainder portion of 40 mol % having been changed to 2:8 to 5:5 (x=0.2 to 0.5), and their characteristic properties were measured.

The results are shown in Table 1. Each coating consisted of PdO, Pt, and $(Ru_xTi_{1-x})O_2$, the quantity of the components being as shown in Table 1.

Electrodes Nos. 2 to 4 are not different from the electrode No. 1 in their chlorine overpotential, and the chlorine generating efficiency thereof was also very high, being 91% and above. Further, both peeling test and accelerated test showed extremely favorable characteristics, as is the case with the No. 1 electrode.

The loading of these electrodes No. 5 to No. 11 are shown in Table 1, the compositional ratio of which was substantially same as the composition of the coating liquid. Table 1 indicates the characteristic properties of each of these electrodes No. 5 to No. 12, which were measured in the same manner as in Example 1.

From the results shown in Table 1, the following will be seen.

With the comparative electrode No. 5, in which a value x in $(Ru_xTi_{1-x})O_2$ exceeds 0.5, the Ru-Ti oxide possesses electrocatalytic activity owing to which the chlorine generating efficiency lowers and its characteristic becomes lower than that of the conventional one, when compared with the electrodes Nos. 9 to 10.

With the comparative electrode No. 6, in which x is 1 and $RuO_2$ alone is contained without inclusion of Ti, $RuO_2$ possesses the electrocatalytic activity to lower the chlorine generating efficiency. Such electrode is not able to satisfy the characteristics in its practical use, and its peeling strength is also lowered.

With the comparative electrode No. 7, in which x is zero and $TiO_2$ alone is contained without inclusion of Ru, the chlorine overpotential becomes extremely large, its chlorine generating efficiency considerably lowers, and the life of the electrode becomes extremely short, hence a satisfactory electrode is not obtained.

With the comparative electrode No. 8 which is low in PdO but high in the content of Ru-Ti oxide, the chlorine overpotential becomes extremely large, the chlorine generating efficiency lowers, and further the life of the electrode becomes short.

With the comparative electrode No. 9 not containing therein the Ru-Ti oxide, its film strength is extremely low, in particular, hence a satisfactory electrode is not obtained. In this connection, an unremarkable improvement in these characteristics can be seen even in the comparative electrode No. 10 obtained by applying the two-liquid type coating liquid which is not advantageous in the electrode production.

The comparative electrode No. 11 consisting of $RuO_2$ alone reveals that the chlorine overpotential thereof is extremely high and its chlorine generating efficiency is also extremely low.

Further, the comparative electrode No. 12 consisting of Ru-Ti oxide added with 70 mol % of $TiO_2$ to this electrode No. 11 is extremely high in its chlorine overpotential, while its chlorine generating efficiency is low.

In this way, the $RuO_2$ electrode (No. 11) with a low chlorine generating efficiency can be improved its efficiency by addition of $TiO_2$ (thereto (No. 12), although the chlorine overpotential deteriorates considerably in an inverse manner.

However, even in the presence of such Ru-Ti oxide, when use is made of PdO which has excellent electrocatalytic activity, and the Ru-Ti oxide in a predetermined quantitative ratio and a predetermined composition (No. 1 to 4), the chlorine overpotential and the chlorine generating efficiency indicate the perfectly equal characteristics as those when PdO alone is used (No. 9 and 10), wherein the Ru-Ti oxide functions as the electrically conductive combining material, and yet PdO alone exhibits the electrocatalysis, hence excellent electrode characteristic can be obtained. Moreover, the characteristics of the film strength and the life thereof as exhibited are much superior in that case.

It will be seen from the results of the electrodes Nos. 1 to 7 that the value of x in $(Ru_xTi_{1-x})O_2$ should be in a range of from 0.05 to 0.5.

Furthermore, the type of electrode with less PdO content (No. 8) is seen to be of no practical utility at all in respect of its electrode characteristics, even if the film strength is high.

EXAMPLE 3

In the same manner as in Example 1, the quantity of Pt in the composition of the coating liquid was fixed to 10 mol %, and a ratio y of PdO and a ratio x of Ru and Ti were changed, thereby producing electrodes Nos. 13 to 24.

The chlorine generating efficiency of these electrodes Nos. 13 to 24 is shown in Table 2 below.

The loading of Pd in these electrodes Nos. 13 to 24 was so made that it became approximately 1 mg/cm$^2$.

From the results shown in Table 2, it will be seen that favorable electrode characteristics can be obtained with the PdO content of from 40 to 90 mol % and the value of x in $(Ru_xTi_{1-x})O_2$ ranging from 0.05 to 0.5.

TABLE 2

| Electrode No. | $(PdO)_yPt_{10}[(Ru_xTi_{1-x})O_2]_{90-y}$ x | y | Chlorine Generating Efficiency (%) |
|---|---|---|---|
| 13 | 0.2 | 85 | 91 |
| 14 | " | 70 | 91 |
| 15 | " | 50 | 91 |
| 16 (Comp.) | " | 30 | 89 |
| 17 | 0.3 | 85 | 91 |
| 18 | " | 70 | 91 |
| 19 | " | 50 | 91 |
| 20 (Comp.) | " | 30 | 88 |
| 21 | 0.4 | 85 | 91 |
| 22 | " | 70 | 91 |
| 23 | " | 50 | 91 |
| 24 (Comp.) | " | 30 | 88 |

EXAMPLE 4

In the same manner as in Example 1, the electrodes Nos. 25 to 30 were manufactured with PdO having been fixed at 50 mol %, the value of x in $(Ru_xTi_{1-x})O_2$ within the range of the present invention, and the quantity of Pt having been varied in the range of from 0 to 30 mol %, in the composition of the coating liquid.

The characteristics of the resulted electrodes Nos. 25 to 30 are shown in Table 3 below.

The loading of Pd in these electrodes Nos. 25 to 30 was so made as to be approximately 1 mg/cm$^2$.

The electrodes Nos. 26 to 29 all indicated excellent values in respect of their chlorine overpotential, chlorine generating efficiency, film strength, and service life. On the contrary, the electrode No. 25 with Pt=0 was found particularly low in its chlorine generating efficiency, and the electrode No. 30 with Pt=20 mol % and above was found particularly low in both chlorine generating efficiency and service life.

TABLE 3

| | Electrode No. | Composition of the coating liquid (mol %) Pd | Pt | Ru | Ti | Ir | Sn | Ce | Chlorine Overpotential (V) | Chlorine Generating Efficiency (%) | Peeling Test | Acceleration Test (Electrolytic Time) |
|---|---|---|---|---|---|---|---|---|---|---|---|---|
| 25 | (Comp.) | 50 | — | 15 | 35 | — | — | — | ≦0.02 | 87 | ○ | ○ |
| 26 | | 50 | 1 | 9.8 | 39.2 | — | — | — | ≦0.02 | 90 | ◎ | ◎ |
| 27 | | 50 | 5 | 9 | 36 | — | — | — | ≦0.02 | 91 | ◎ | ◎ |
| 28 | | 50 | 10 | 8 | 32 | — | — | — | ≦0.02 | 91 | ○ | ◎ |
| 29 | | 50 | 20 | 6 | 24 | — | — | — | ≦0.02 | 91 | ◎ | ◎ |
| 30 | (Comp.) | 50 | 30 | 9 | 21 | — | — | — | ≦0.02 | 89 | ◎ | Δ |
| 2 | | 50 | 10 | 12 | 28 | — | — | — | ≦0.02 | 91 | ◎ | ◎ |
| 31 | | 50 | 10 | 12 | — | — | 28 | — | 0.03–0.05 | 88 | ○ | ○ |
| 32 | | 50 | 10 | — | 28 | 12 | — | — | 0.04–0.08 | 90 | ◎ | Δ |

TABLE 3-continued

| | Electrode No. | Composition of the coating liquid (mol %) Pd | Pt | Ru | Ti | Ir | Sn | Ce | Chlorine Over-potential (V) | Chlorine Generating Efficiency (%) | Peeling Test | Acceleration Test (Electrolytic Time) |
|---|---|---|---|---|---|---|---|---|---|---|---|---|
| 33 | Comparison | 50 | 10 | — | — | 12 | 28 | — | 0.03–0.07 | 89 | ○ | Δ |
| 34 | | 50 | 10 | — | — | — | — | 40 | >0.1 | 75 | ◎ | X |

COMPARATIVE EXAMPLE 2

In the same manner as in Example 1, electrodes of various compositions of PdO—Pt—(Ru—Sn)$O_2$, PdO—Pt—(Ir—Ti)$O_2$, PdO—Pt—(Ir—Sn)$O_2$, and PdO—Pt—$CeO_2$ were manufactured.

The composition of the coating liquid was made such that PdO and Pt were fixed at 50 mol % and 10 mol % respectively, and the remainder of 40 mol % was composed of Ru or Ir and Ti or Sn at a fixed ratio of 3:7, or of $CeO_2$.

(Ir-Ti)$O_2$ in the coating liquid was so prepared that iridium tetrachloride and tetrabutoxy titanium, as the starting salts, were dispersed and dissolved in a mixed solution of 1 ml of hydrochloric acid and 19 ml of butanol in the same manner as in Example 1 above. The type of the coating liquid, in which Sn is used, was prepared by adding ammonium tartarate to stannic chloride, and was made into an aqueous solution containing therein ruthenium chloride or iridium chloride.

For preparation of $CeO_2$, cerous chloride was used with ethyl alcohol as a solvent.

The characteristics of the resulted electrodes Nos. 31 to 34 are shown in Table 3.

Incidentally, the loading of Pd in these electrodes Nos. 31 to 34 was so made as to be approximately 1 mg/cm$^2$.

The electrode No. 31 is one, wherein Ru-Sn oxide is used. In this electrode, the chlorine overpotential became somewhat greater, and the chlorine generating efficiency lowered.

The electrodes Nos. 32 and 33 are those, wherein Ir was used in place of Ru. In these electrodes, the chlorine overpotential fluctuated considerably, and their service life was shortened remarkably as the result of the accelerated tests.

From the above, it is apparent that the Ru-Ti type oxide alone indicates superior characteristics as the binding material.

Electrode No. 34 with other oxides such as $CeO_2$, as the binding material is found to be inferior in its characteristics.

We claim:

1. An electrode for electrolysis having a coating which consists essentially of 40 to 90 mole % of palladium oxide, 0.1 to 20 mole % of platinum, and 5 to 50 mole % of $(Ru_xTi_{1-x})O_2$, wherein x ranges from 0.05 to 0.5, based on the total molar composition.

2. An electrode for electrolysis having a coating according to claim 1, wherein said palladium oxide comprises 50 to 90 mole %, based on the total molar composition.

3. An electrode for electrolysis having a coating according to claim 1, which further consists of various oxides selected from the group consisting of the oxides of cerium, zirconium, titanium, tantalum, tungsten, silicon, lead, tin and antimony, in the range of 10 mole % or less, based on the total molar composition.

4. A process for producing an electrode for electrolysis which comprises:

coating on an electrically conductive base material, a coating liquid comprising:

(a) palladium oxide, (b) a compound which is converted to platinum metal upon pyrolysis, (c) a compound which is converted to ruthenium oxide upon pyrolysis, (d) a compound which is converted to titanium oxide upon pyrolysis, and (e) a solvent; and heating the coated electrically conductive base, thereby forming a coating on said base having a composition consisting essentially of:

(a) 40 to 90 mole % of palladium oxide, (b) 0.1 to 20 mole % of platinum metal, and (c) 5 to 50 mole % of $(Ru_xTi_{1-x})O_2$, wherein x ranges from 0.05 to 5, based on the total molar composition.

5. A process according to claim 4, wherein said compound which is converted to platinum metal upon pyrolysis is chloroplatinic acid.

6. A process according to claim 4, wherein said compound which is converted to ruthenium oxide upon pyrolysis is ruthenium chloride.

7. A process according to claim 4, wherein said compound which is converted to titanium oxide upon pyrolysis is tetrabutoxy titanium.

8. A process according to claim 4, wherein said electrically conductive base material is a valve material selected from the group consisting of titanium, tantalum, zirconium, and niobium metals.

9. A process according to claim 4, wherein said heating comprises heating said coated electrically conductive base for a period of 5 minutes to 1 hour at a temperature in the range of 400° to 800° C.

10. A process according to claim 4, wherein the steps of coating and heating are effected in the same sequence more than once.

11. A process according to claim 4, wherein said coating liquid is a coating liquid having a total metal concentration of 0.01 to 10 g/ml.

12. A process according to claim 4, wherein said solvent is water, ethanol, propanol, butanol or a mixture thereof.

* * * * *